US005637003A

United States Patent [19]

Takahashi

[11] Patent Number: 5,637,003

[45] Date of Patent: Jun. 10, 1997

[54] LEVER CONNECTOR

[75] Inventor: Hiroki Takahashi, Shizuoka, Japan

[73] Assignee: Yazaki Corporation, Tokyo, Japan

[21] Appl. No.: 392,486

[22] Filed: Feb. 23, 1995

[30] Foreign Application Priority Data

Feb. 23, 1994 [JP] Japan ..... 6-025540

[51] Int. Cl.[6] ..... H01R 13/62

[52] U.S. Cl. ..... 439/157; 439/153

[58] Field of Search ..... 439/152–160, 439/372, 351, 352

[56] References Cited

U.S. PATENT DOCUMENTS 4,474,462 10/1984 Yamanashi ..... 439/153
4,954,928 9/1990 Jullien ..... 439/160
5,238,417 8/1993 Hatagishi ..... 439/153
5,482,394 1/1996 Shinchi et al. ..... 439/153

FOREIGN PATENT DOCUMENTS 487169 3/1992 Japan .

*Primary Examiner*—David L. Pirlot
*Attorney, Agent, or Firm*—Sughrue, Mion, Zinn, Macpeak & Seas

[57] ABSTRACT

A female connector and a male connector engageable with each other are paired. Fixing shafts are projected from both lateral sides of the male connector. The female connector has a retaining lever being pivotable about pivots arranged on both lateral sides thereof. Rail portions are arranged on a front surface of the lever, each rail portion having a predetermined surface of curvature. When the male connector is inserted into the female connector, shaft portions of the fixing shafts are abutted against the rail portions and bias the rail portions, so that the surfaces of curvature produce resisting forces, each having a component for pivoting the lever.

4 Claims, 9 Drawing Sheets

LEVER CONNECTOR

BACKGROUND OF THE INVENTION

1. Field of the Invention

The invention relates to a lever connector requiring only a small inserting and pulling force, which is adapted for use chiefly in mutually connecting wire harnesses for automobiles. More particularly this invention relates to a low insertion-withdrawal force connector of the lever type used for interconnecting wire harnesses used mainly in automobiles, and to a reinforcing structure for a lever lock for preventing an accidental disengagement of connectors from each other.

2. Related Art

A conventionally known connector of this type is shown in FIGS. 8 and 9. This connector using a spring is disclosed in Japanese Unexamined Patent Publication Hei. 4-87169.

In the process of bringing an intermediately inserted condition of male and female connectors 101, 102 in FIG. 8 into a completely inserted condition thereof in FIG. 9, a lock projection 104 of a cam lever 103 that is pivotably arranged on the connector 102 first pushes a lock portion 108 down with a tapered engagement portion 105 of the lock projection 104 sliding over a tapered engagement portion 109 of the lock portion 108 in a lock arm 107 on the connector 101 side, and then reaches the bottom of the lock portion 108 while passing over the lock portion 108 upon complete insertion. As a result, both connectors are regularly retained as shown in FIG. 9.

If the cam lever 103 is in the lowered condition while both connectors 101, 102 are being engaged, the way of the connector 101 is blocked, thus not allowing the connector 101 to be further inserted.

To overcome this problem, the operator has to first manually return the cam lever 103 to the elevated initial position at the time of starting the engagement of both connectors 101, 102, and then insert the connector 101 into the connector 102 for temporary engagement, which is a cumbersome operation.

Therefore, to dispense with this cumbersome operation, the conventional lever connector is so designed that a coil spring 106 is additionally provided at the shaft portion of the cam lever 103 arranged on the connector 102 so that the cam lever 103 is urged to be erected at the initial position.

As described above, in the conventional art, the initial position of a retaining lever (the cam lever 103 in the aforementioned example) is strictly limited in the process of assembling the connector.

To permit easy operation, a mechanism such as a spring (the coil spring 106 in the aforementioned example) must be arranged to set the retaining lever to the limited initial position, which has made it difficult to achieve an inexpensive connector.

SUMMARY OF THE INVENTION

The invention has been made to overcome the aforementioned problems and shortcomings. Accordingly, the object of the invention is to provide a lever connector that can achieve reliable insertion and retainment with a simple operation at a low cost irrespective of the initial position of the retaining lever in the process of assembling the connector.

Another object of the invention is to provide a reinforcing structure for a lever lock which prevents the lever lock from being broken or deformed even if any external force acts thereon, and can be molded by a mold designed to be simply removed in one direction.

To achieve the above object, the invention is applied to a lever connector comprising a pair of connectors engageable with each other, one of the connectors having fixing shafts on both lateral sides thereof so as to be projected, and the other connector having a retaining lever being pivotable about pivots arranged on both lateral sides thereof. Rail portions are arranged on a front end of the retaining lever, each rail portion having a surface of curvature. In such a lever connector, when the connector having the fixing shafts is inserted into the other connector having the retaining lever, shaft portions of the fixing shafts are abutted against the rail portions and bias the rail portions to thereby produce resisting forces, and each surface of curvature is designed so that each resisting force has a component for pivoting the retaining lever.

In the lever connector of the invention, engagement grooves are formed in both lateral sides of the other connector, the engagement grooves allowing the fixing shafts to be inserted thereinto; the retaining lever has retaining grooves so as to extend inward; and pivoting of the lever is stopped upon coincidence of the engagement grooves with the retaining grooves.

To achieve the above object, the present invention provides a lever lock-reinforcing structure for a lever-type connector wherein a pivotal retaining lever is provided on one of a pair of connectors to be fitted together; and the other connector is fitted relative to the one connector by pivotal movement of the retaining lever, and has a lever lock portion for retaining the retaining lever, wherein the lever lock portion comprises an upstanding, elastic lock plate extending from an outer surface of a housing of the other connector, a lock release portion extending from a free end of the elastic lock plate, and upstanding side walls provided respectively on opposite sides of the elastic lock plate; a forward-fall prevention member is mounted on and extends from the side walls, and is disposed at a front position within the range of flexing of the lock release portion displaceable in accordance with elastic deformation of the elastic lock plate, and an upper surface of the lock release portion can strike against the forward-fall prevention member.

In the lever lock-reinforcing structure of the present invention, a rearward-fall prevention member is formed on and projected from an inner surface of each of the side walls, and extends along an axis of the housing, and a lower surface of the lock release portion can strike against the rear-fall prevention members upon elastic deformation of the elastic lock plate.

When the connector having the fixing shafts is inserted into the connector having the lever, the shaft portions of the fixing shafts bias the rail portions while abutted against the rail portions. Resisting forces are produced at the abutted portions by the biasing, and a component of each resisting force for pivoting the lever causes the lever to pivot about the pivots of the lever.

Since the surface of curvature of each rail portion of the lever is designed so that the produced resisting force has a component for pivoting the lever no matter where the lever is positioned, the operation of engaging both connectors can be started at an arbitrary initial position without having the lever set to a predetermined initial position.

The lock lever portion has the forward-fall prevention member extending between the side walls provided upright on the opposite sides of the elastic lock plate, and the upper surface of the lock release portion of the lock plate can strike against this forward-fall prevention member. Therefore, even if a large external force acts on the lock release portion, this force will not act on a bent portion interconnecting the lock release portion and the elastic lock plate, and therefore this interconnecting portion is prevented from breakage and deformation.

Moreover, since the lock plate, the lock release portion, the forward-fall prevention member and the rearward-fall prevention members are all provided along the axis of the housing, a mold will not become complicated, and the structure can be molded by a mold removable in one direction. This reduces the manufacturing cost.

DETAILED DESCRIPTION OF THE PREFERRED EMBODIMENTS

An embodiment of the invention will now be described with reference to FIGS. 1 to 7 out of the accompanying drawings.

Figure 1:
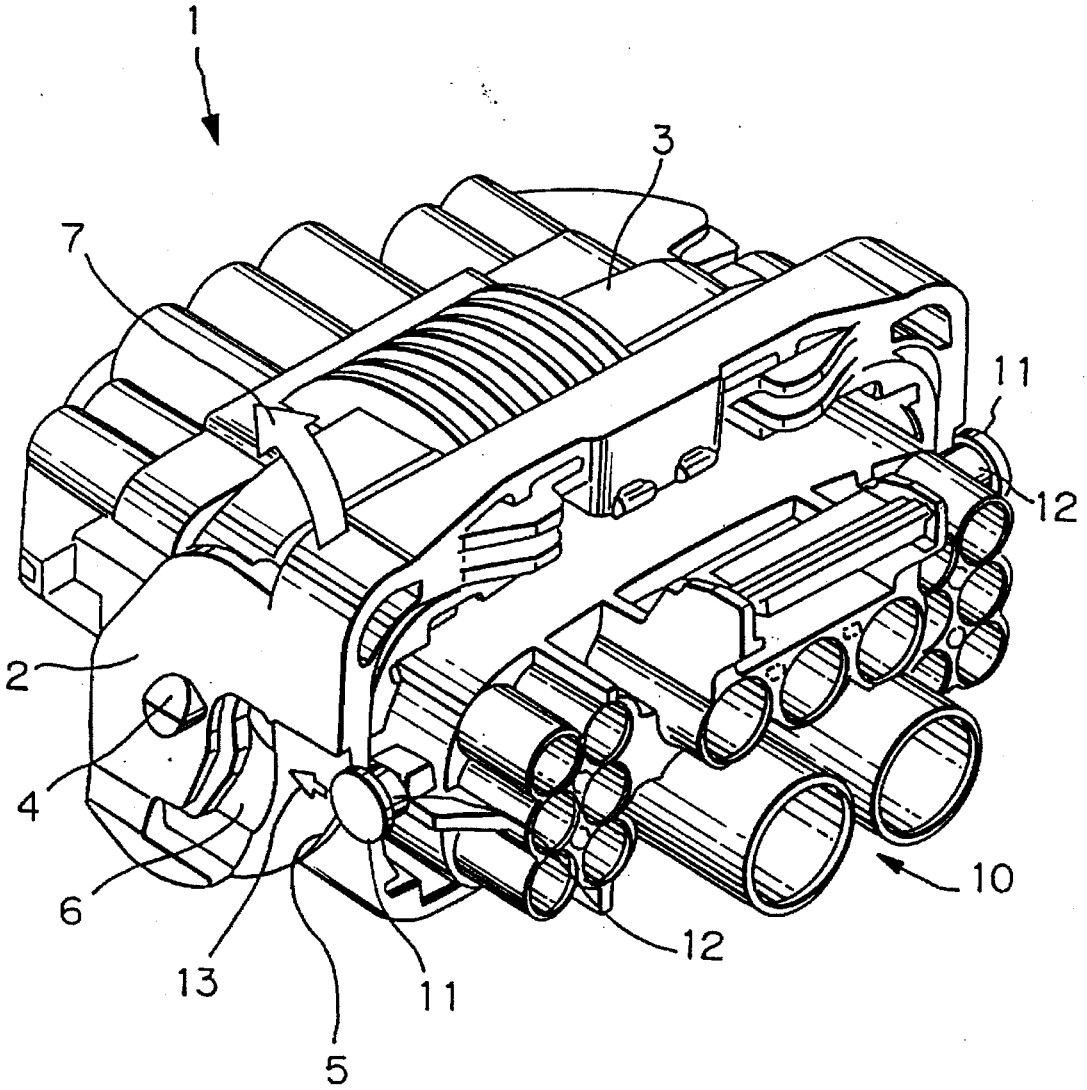
FIG. 1 is a perspective view of a lever connector, which is an embodiment of the invention.

FIG. 1 is a perspective view showing a lever connector, which is the embodiment of the invention.

In FIG. 1 a lever connector 1 is composed of a female connector 3 and a male connector 10 that are engageable with each other. FIG. 1 shows a condition in which insertion of the male connector 10 into the female connector 3 is started with the male connector 10 being advanced in a direction indicated by an arrow, which is a fixing shaft moving direction.

The male connector 10 has on both lateral sides thereof fixing shafts 11 formed so as to be projected outwardly, each fixing shaft having a recessed shaft portion 12 formed thereon. The female connector 3 has a retaining lever 2 that is pivotable about pivots 4 arranged on both lateral sides thereof.

In the front surface of the retaining lever 2 are rail portions 5, each of which has a predetermined surface of curvature, and in both lateral sides thereof are retaining grooves 6, which extend inward.

At the time the male connector 10 is inserted into the female connector 3, the shaft portion 12 of each fixing shaft 11 of the male connector 10 is abutted against the corresponding rail portion 5 and biases such rail portion 5. The biasing forces produce resisting forces at the abutted portions, respectively. Each surface of curvature is designed so that the resisting force has a component for pivoting the lever 2.

In addition, no matter which position of the rail portion the shaft portion 12 is abutted against and biased, each surface of curvature is designed so that the resisting force produced at that portion has a component for pivoting the lever 2 at all times.

For example, the front surface of each rail portion 5 is formed of a projected surface of curvature, or at least the front surface of each rail portion 5 corresponding to the entire lever 2 pivoting range is formed of a projected surface of curvature.

As a result of forming each rail portion 5 of either one of the aforementioned projected surfaces of curvature, a resisting force "b" produced at an abutted portion has a component "c" that is perpendicular to a line segment connecting the pivot 4 and the abutted portion and that is directed upward (see FIG. 4) no matter which position of the rail portion 5 the shaft portion 12 is abutted against and biased.

Figure 4:
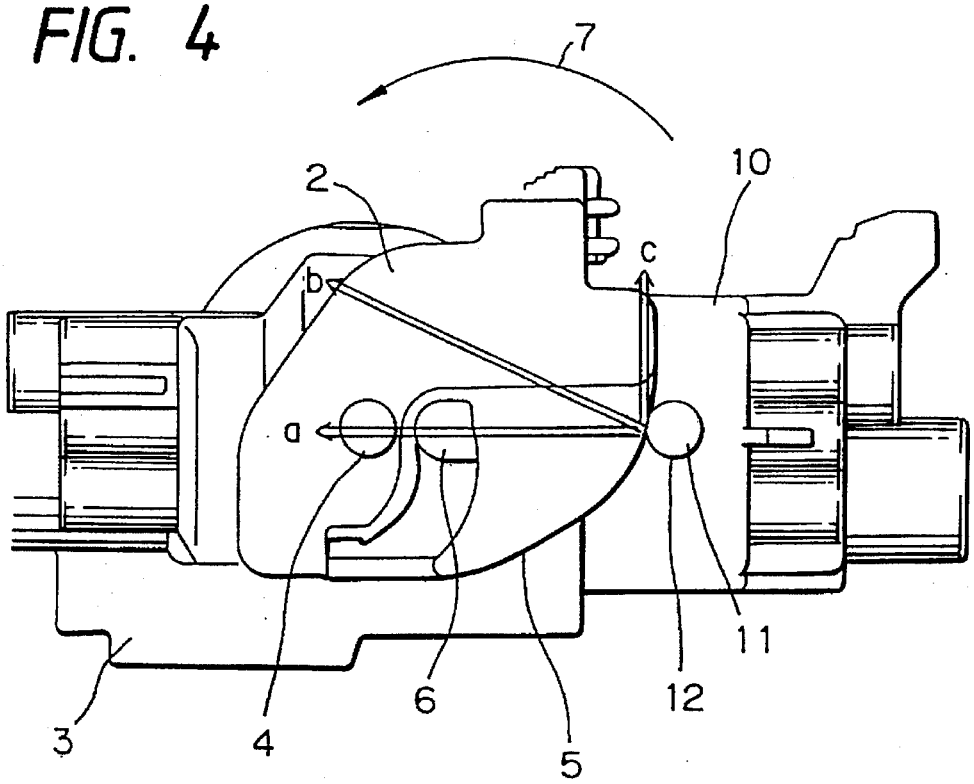
FIG. 4 is a front view showing a process in which the lever connector of FIG. 1 is being inserted.

This resisting force component "c" causes the lever 2 to pivot about the pivots 4 in a lever pivoting direction 7 shown in FIG. 4. Therefore, since the resisting force component "c" is produced by the biasing of each shaft portion 12 onto the corresponding rail portion 5 no matter which position of the rail portion 5 the shaft portion 12 is abutted against, a force for pivoting the lever 2 is applied to the lever 2 as long as the shaft portion 12 is abutted against the rail portion 5. Hence, the lever 2 can continue pivoting smoothly.

Figure 2:
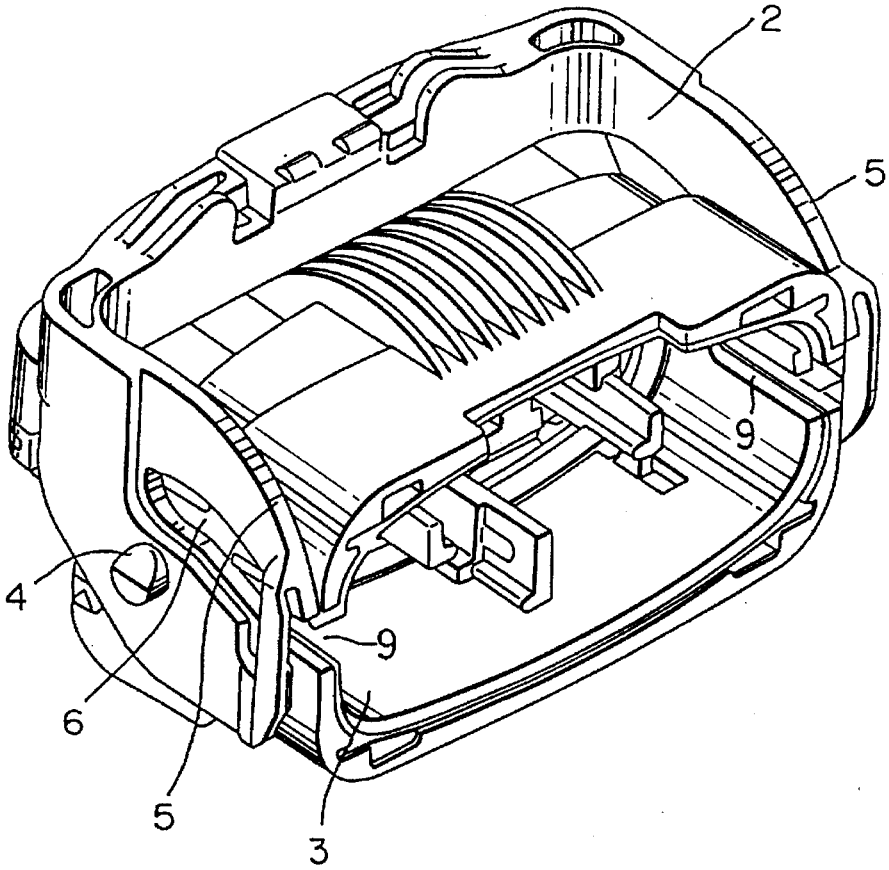
FIG. 2 is a perspective view of a female connector of FIG. 1.
Figure 3:
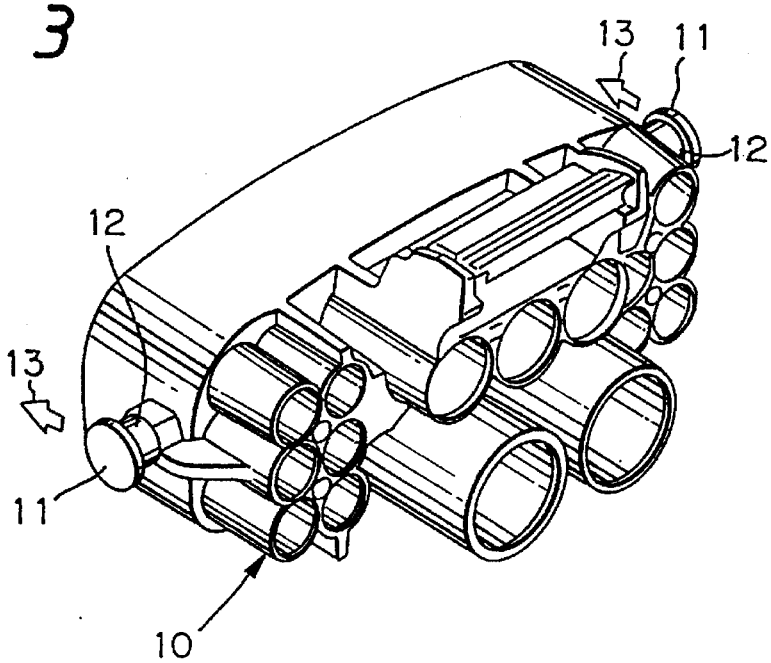
FIG. 3 is a perspective view of a male connector of FIG. 1.

FIGS. 2 and 3 are perspective views showing the female connector 3 and the male connector 10 constituting the lever connector shown in FIG. 1, respectively. FIG. 2 shows the lever 2 being pivoted completely upward. This lever condition is merely an example; the operation of engaging both connectors 3, 10 can be performed smoothly no matter where the lever 2 is positioned.

It should be noted that the retaining lever 2 is designed so that the end portions of the rail portion 5, which correspond to the front surface of the connector in such a condition as shown in FIG. 2, are expanded outward, and that the female connector 3 has engagement grooves 9 on both lateral sides thereof so that the fixing shafts 11 of the male connector 10 can be inserted into the engagement grooves 9 after passing through the rail portions 5 at the time the male connector 10 is inserted into the female connector 3.

That is, the female connector 3 shown in FIG. 2 is in a condition in which the engagement grooves 9 and the retaining grooves 6 of the lever 2 are coincident with each other.

A mode of operation of the lever connector of the invention will be described next with reference to FIGS. 4 to 7, which are front views showing a series of processes of engaging the lever connector of FIG. 1.

FIG. 4 is a front view corresponding to FIG. 1 and shows a condition in which the operation of inserting the male connector 10 into the female connector 3 is started.

As shown in FIG. 4, the lever 2 arranged on the female connector 3 is fallen down completely, which is an exemplary condition. Here, the shaft portion 12 of the fixing shaft 11 disposed on each lateral side of the male connector 10 is abutted against the corresponding rail portion 5 having a predetermined surface of curvature.

As the male connector 10 is further pushed in, a force "a" acting on the abutted portion in the fixing shaft moving direction is applied to the lever 2, which causes the perpendicular resisting force "b" in the normal direction of the tangential plane to be generated with respect to the lever 2 as shown by the arrow "b" in FIG. 4. The component "c" of the perpendicular resisting force "b" which extends in the direction at right angles to the line connecting the point of contact and the pivot 4 acts to pivot the lever 2 in the pivoting direction 7.

Figure 5:
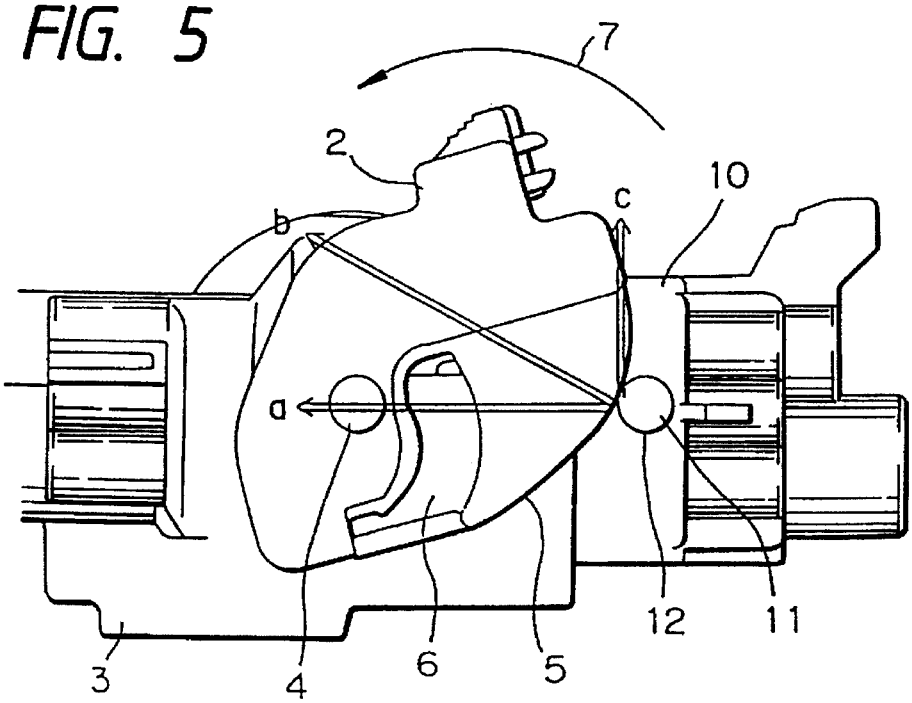
FIG. 5 is a front view showing a process in which the lever connector of FIG. 1 is being engaged.

As a result, the lever 2 pivots in the pivoting direction 7 to some degree as shown in FIG. 5. In association with this pivoting of the lever 2, each shaft portion 12 continuously imparts the resisting force "b" while sliding over the curved surface of the corresponding rail portion, thereby causing the lever 2 to continue pivoting.

Figure 6:
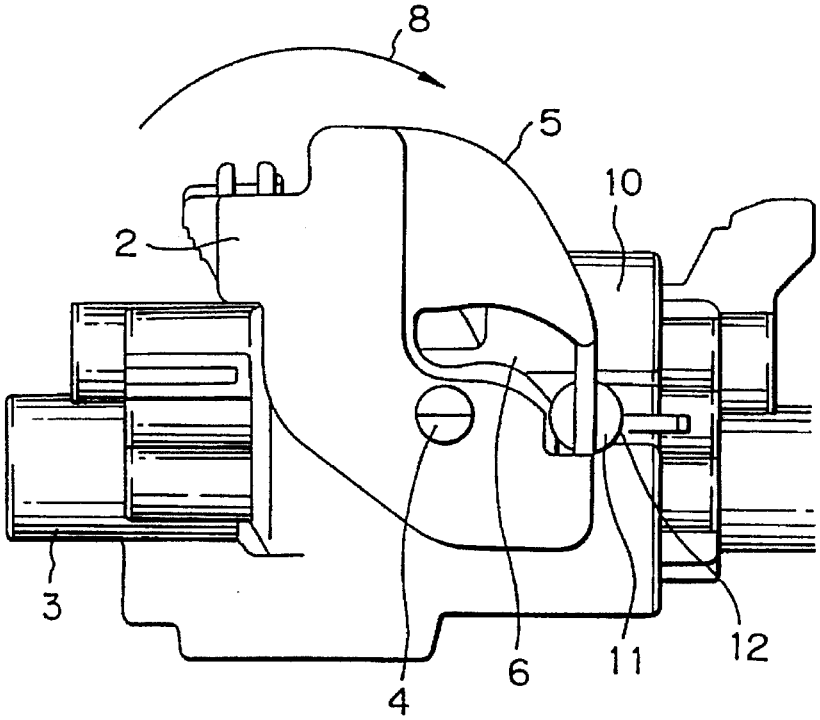
FIG. 6 is a front view showing the lever connector of FIG. 1 in the temporarily engaged condition.

As the male connector 10 is further inserted and the lever 2 is thereby caused to continue pivoting, the male connector 10 soon comes to be inserted into the predetermined position with the lever 2 being pushed up, so that the lever connector is brought into the temporarily engaged condition such as shown in FIG. 6.

Under this temporarily engaged condition, each fixing shaft 11 and shaft portion 12 are positioned along the corresponding retaining groove 6 of the lever 2. To bring this temporarily engaged condition into a regularly engaged condition, i.e., a regularly retained condition, the lever 2 is manually pivoted in a direction opposite to the pivoting direction, i.e., in a rotating direction 8 in FIG. 6.

Figure 7:
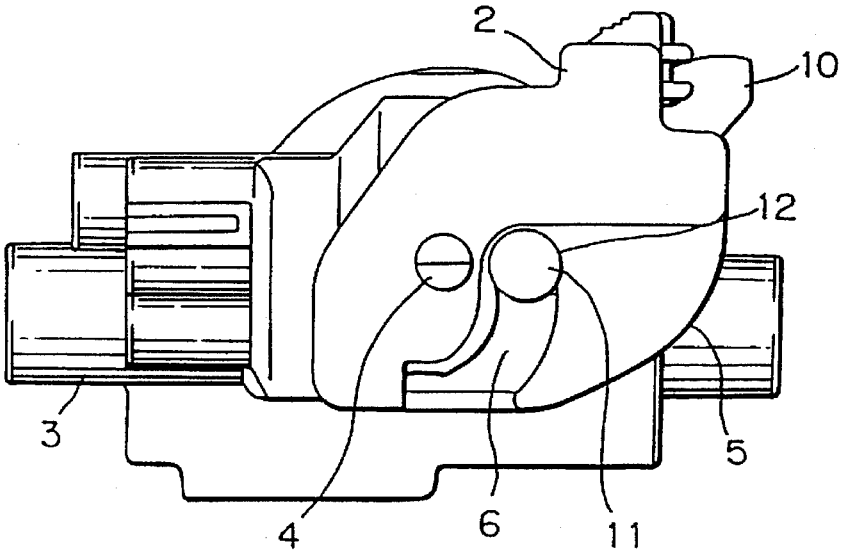
FIG. 7 is a front view showing the lever connector of FIG. 1 in the completely engaged condition.
Figure 8:
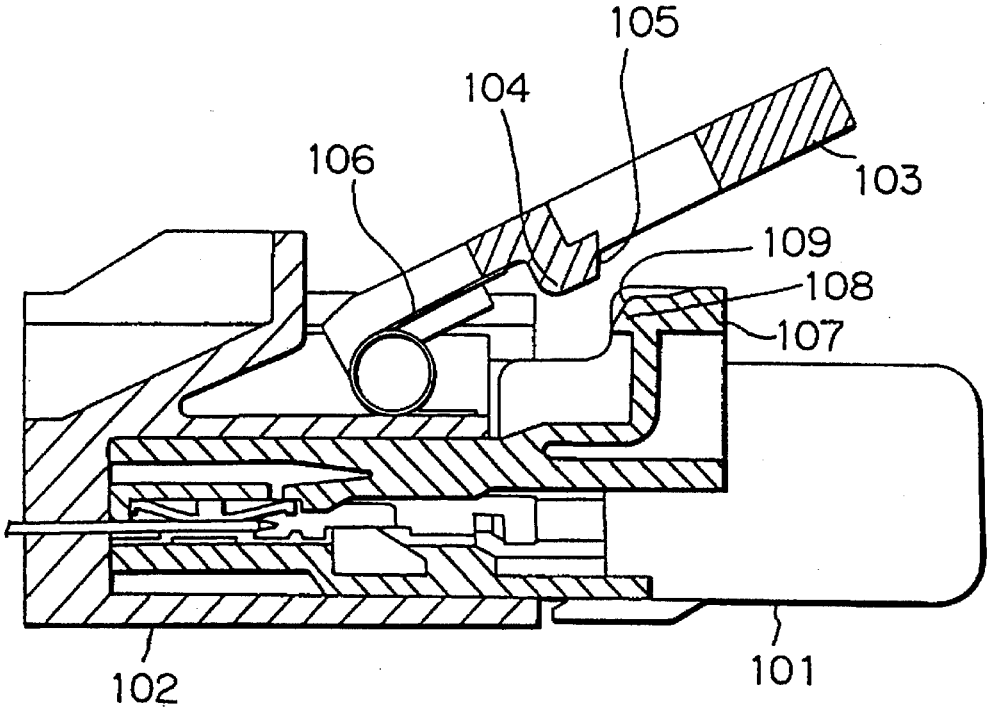
FIG. 8 is a front sectional view of a conventional spring lever connector before engagement.
Figure 9:
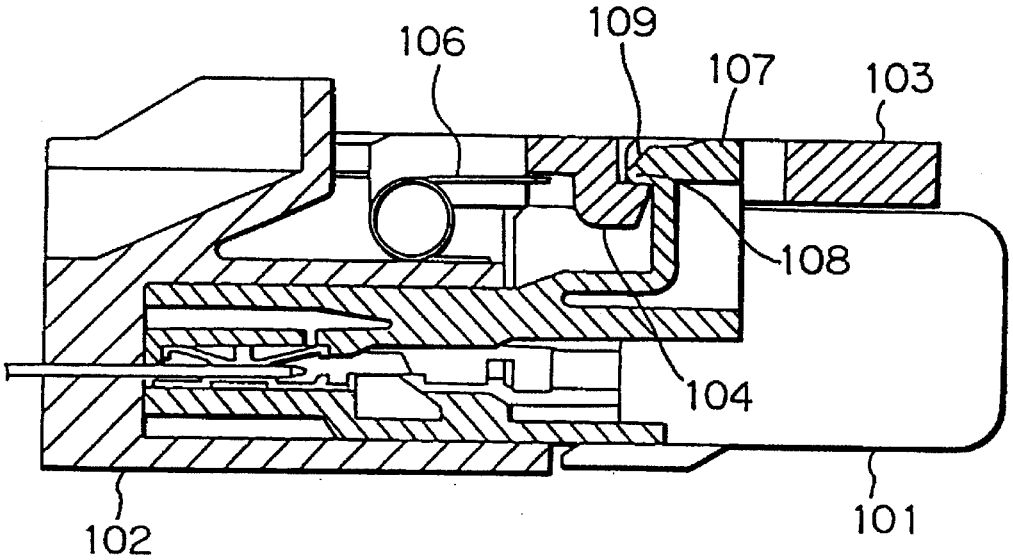
FIG. 9 is a front sectional view of the conventional spring lever connector after engagement.

As a result of the manually pivoting operation, the lever 2 pivots while allowing the shaft portion 12 to slide over the inner wall of the retaining groove 6 thereof because the shaft portion 12 is positioned along the retaining groove 6 of the lever 2, and soon falls down completely with the bottommost portion of the retaining groove 6 thereof gripping the shaft portion 12 as shown FIG. 7. Hence, both connectors 3, 10 are retained.

As is apparent from the foregoing, even if the operation of inserting the male connector 10 into the female connector 3 is started with the lever 2 being not at the position shown in FIG. 4, but at, e.g., the slightly upwardly pivoted position shown in FIG. 5, both connectors can be temporarily engaged as shown in FIG. 6 without any difficulty. That is, according to the construction of the invention, the operation of engaging the connectors can be started without being restricted by the initial position of the lever 2, i.e., with the lever 2 being at an arbitrary position.

This advantage not only improves operability significantly but also eliminates such a member as a spring for holding the lever 2 at a predetermined position in the initial condition, thereby allowing the cost of manufacture of the connector to be reduced and in turn contributing to achieving a reduction in breakdown due to reduction in the number of parts involved. These industrial advantages are not small.

While the aforementioned embodiment is characterized by a combination of the retaining lever with the female connector and a combination of fixing shaft with the male connector, such combinations may, of course, be reversed.

As described in the foregoing, in the lever connector of the invention, a retaining lever is arranged so as to be pivotable about pivots on one of a pair of connectors; shaft portions of fixing shafts arranged on the other connector are caused to be abutted against rail portions of the lever and bias such rail portions, each rail portion having a surface of curvature; and a resisting force produced at each abutted portion as a result of the biasing has a component for pivoting the lever. In addition, each resisting force produced has a component for pivoting the lever at all times no matter where the lever is positioned within the pivoting range thereof. Therefore, the invention can provide an advantage that insertion and retainment of the connectors can be implemented smoothly with the lever being at any initial position.

This advantage brings about additional advantages such as a remarkable improvement in operability at the time of assembling the connector and a significant reduction in the cost of manufacture by dispensing with a spring that has been requisite for holding the lever in a predetermined place in the conventional construction.

A structure of the conventional lever lock portion will now be described in more detail.

Figure 14:
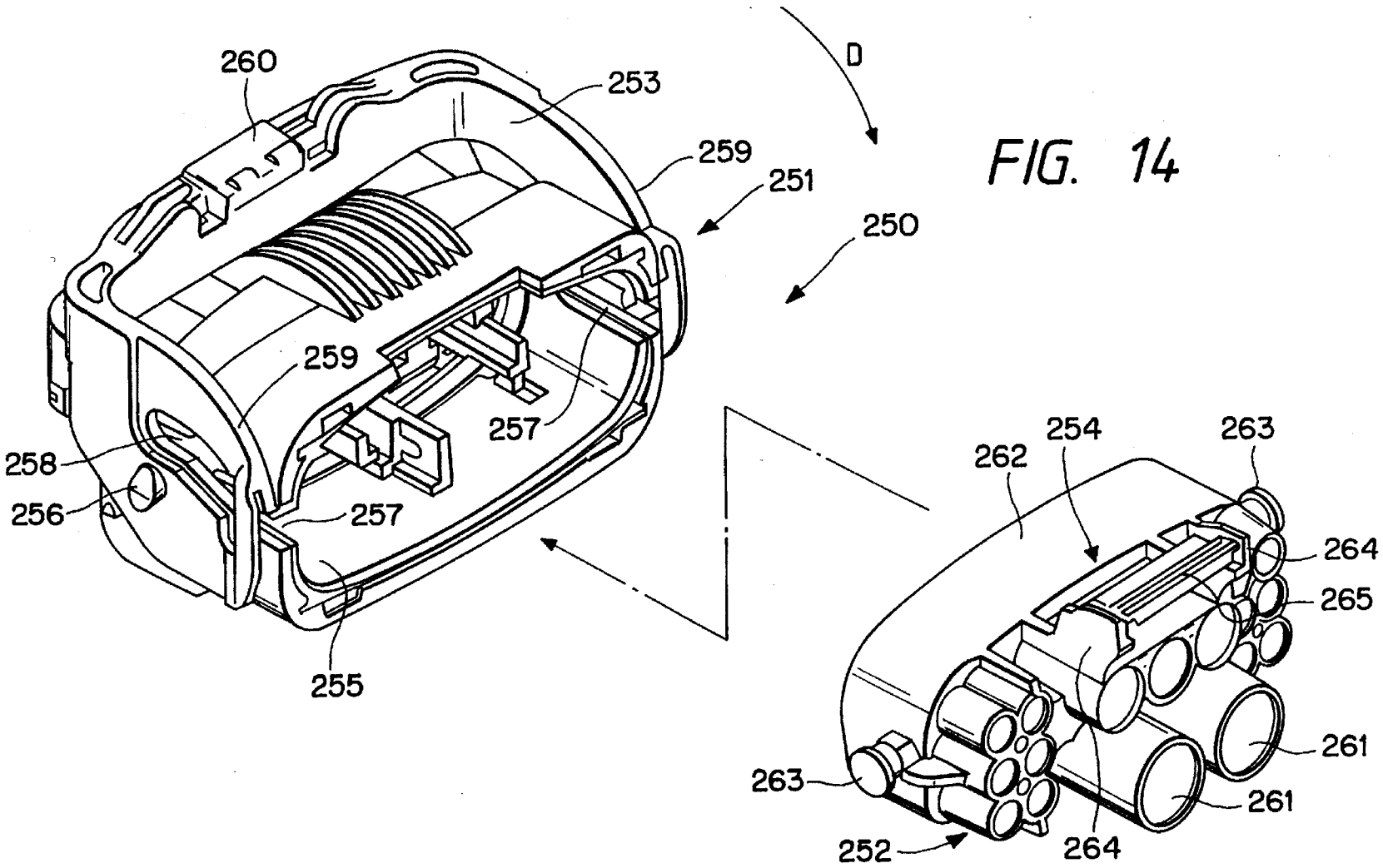
FIG. 14 is an exploded perspective view of a conventional lever-type connector.
Figure 15:
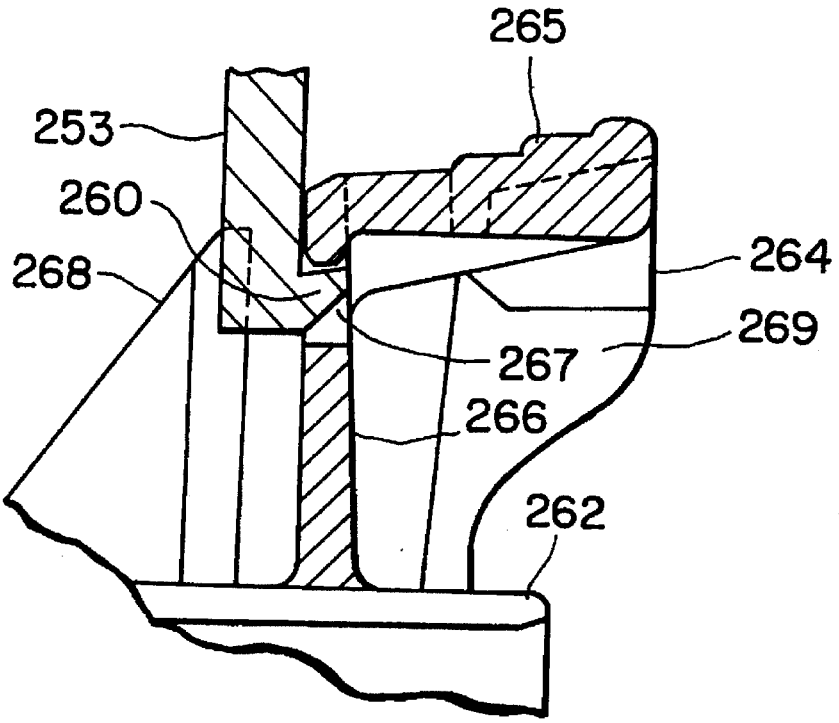
FIG. 15 is a cross-sectional view of a lever lock portion of the lever-type connector of FIG. 14.

As shown in FIGS. 14 and 15, the lever lock portion 254 comprises a pair of upstanding side walls 264 spaced a predetermined distance from each other, and an elastic lock plate 266 (see FIG. 15) provided between the side walls 264 in closely spaced relation thereto, the elastic lock plate 266 being elastically deformable in a forward-backward direction. The elastic lock plate 266 is of an inverted L-shape, and has a lock release portion 265 at its upper portion, as shown in FIG. 15. A retaining hole 267 for retainingly receiving the hook portion 260 upon pivotal movement of the retaining lever 253 is formed through an upper portion of the elastic lock plate 266 disposed adjacent to the lock release portion 265.

A forward-fall prevention rib 268 and a rearward-fall prevention rib 269 are formed on the side wall 264, and are disposed forwardly and rearwardly of the elastic lock plate 266, respectively. These ribs prevent the elastic lock plate 266 from falling beyond predetermined angles when this elastic lock plate is elastically deformed so as to be engaged with and disengaged from the retaining lever 253. The forward-fall prevention rib 268 and the rearward-fall prevention rib 269 project from the inner surface of the side wall 264 to a position where the elastic lock plate 266 is provided, and are molded integrally with the side wall 264.

In the lever-type connector 250 of the above construction, when the male connector 252 is forced or pushed in the direction of the arrow of FIG. 14 regardless of the position of the retaining lever 53, the fixed shafts 263 formed on the male connector 252 press the rail portions 259 of the retaining lever 253 to pivotally move this lever, so that the male connector is brought into a provisionally-fitted condition. As a result, the retaining grooves 258 in the retaining lever 253 are disposed respectively in registry with the fitting grooves 257 in the female connector 251, and the fixed shafts 263 can fit in these grooves.

Then, by pivotally moving the retaining lever 53 forwardly as indicated by arrow D (FIG. 14), the male connector 252 can be fitted into the female connector 51 with a low force, with the fixed shafts 263 guided respectively by the retaining grooves 258.

When the connectors are fitted together, the hook portion 260 of the retaining lever 253 elastically deforms the elastic lock plate 266, and is engaged in the retaining hole 267, thereby fixing the connector 250 in a locked condition in a satisfactory manner.

Another embodiment of the present invention will now be described in detail with reference to FIGS. 10 to 13.

Figure 10:
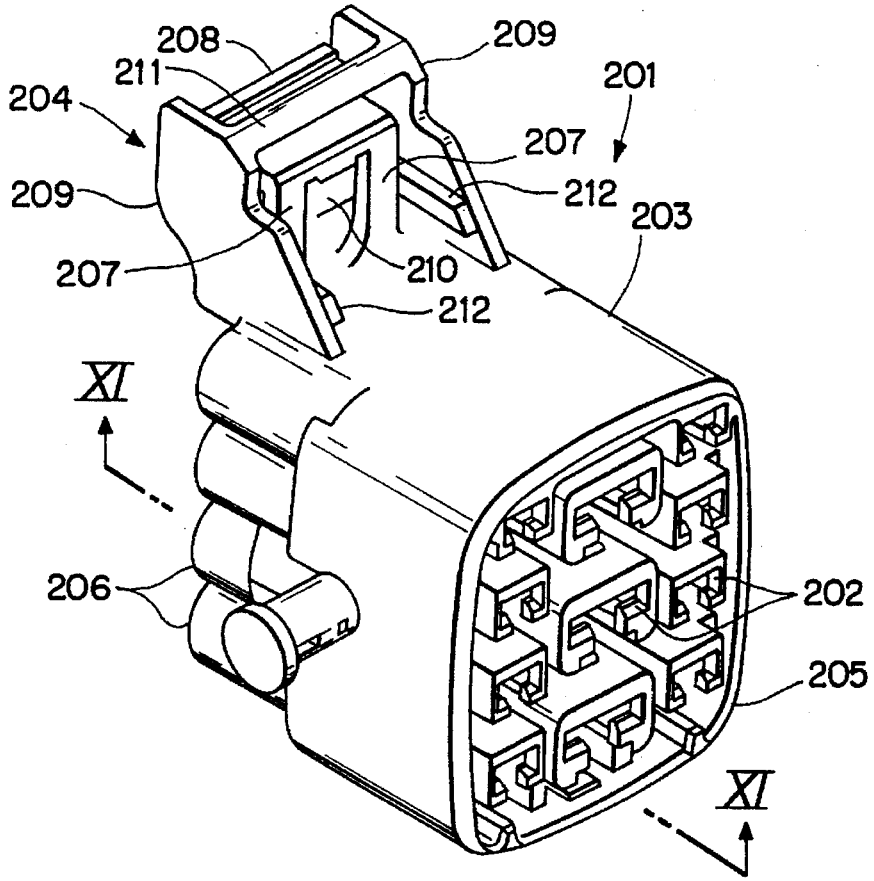
FIG. 10 is a perspective view showing the appearance of a connector incorporating a preferred embodiment of a lever lock-reinforcing structure of the present invention.
Figure 11:
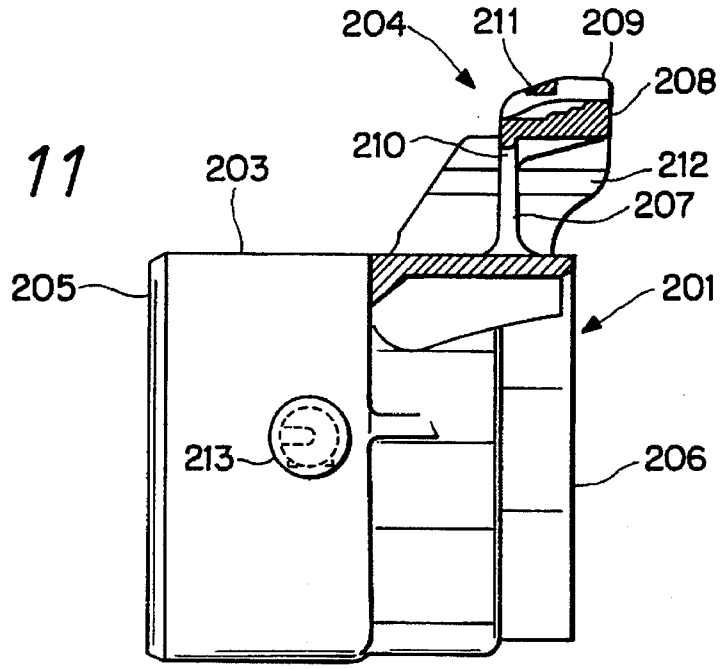
FIG. 11 is a cross-sectional view taken along the line XI—XI of FIG. 10.
Figure 12:
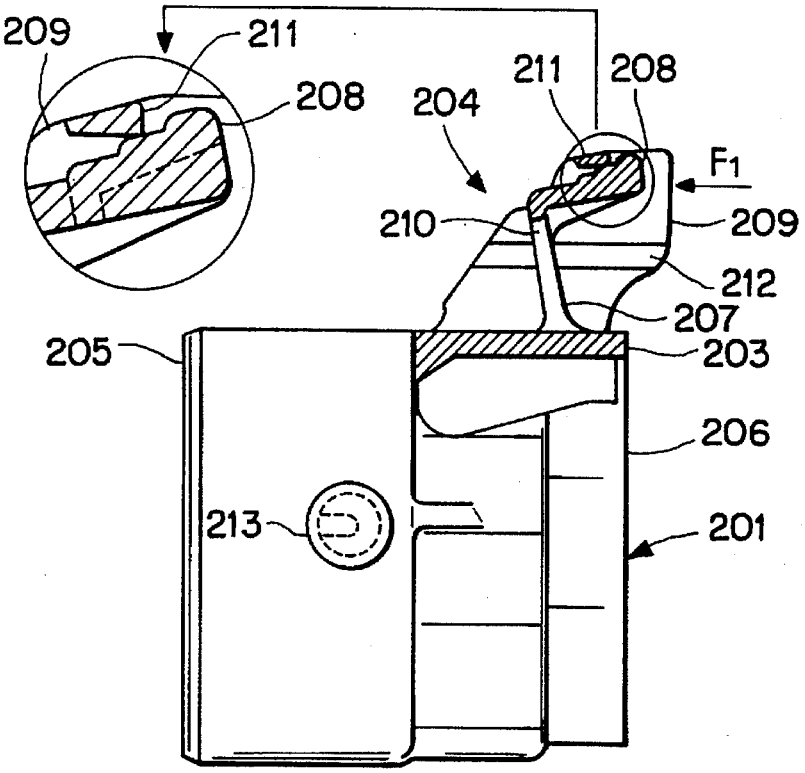
FIG. 12 is a cross-sectional view showing a condition in which an external force acts on a lock release portion of FIG. 11.
Figure 13:
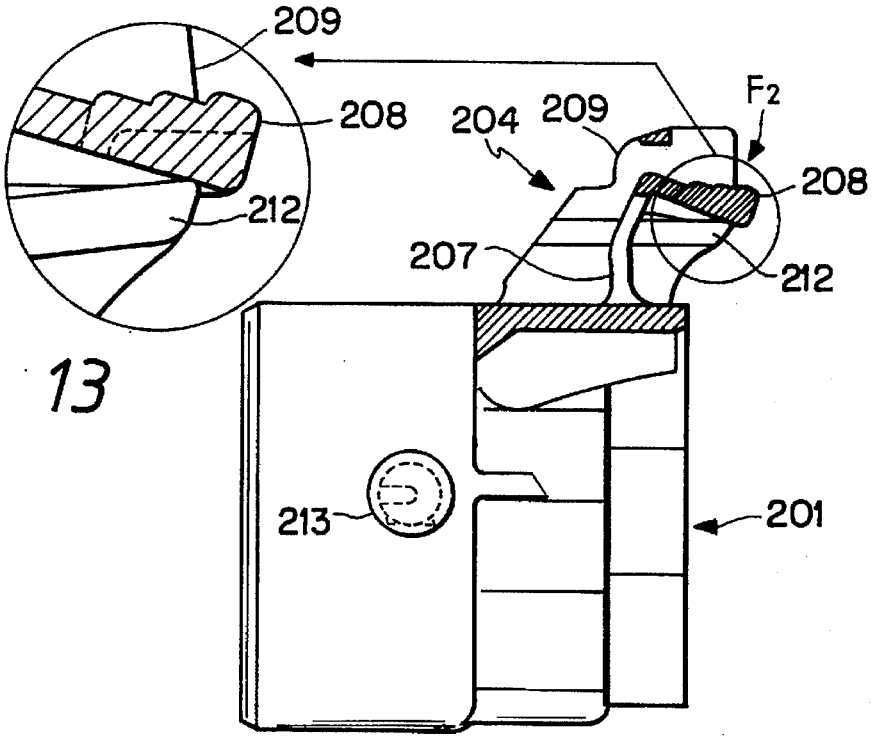
FIG. 13 is a cross-sectional view showing a condition in which an external force acts on the lock release portion of FIG. 11.

In FIGS. 10 and 11, a male connector 201 comprises a housing 203 having a plurality of terminal receiving chambers 202 formed therein, and a lever lock portion 204 formed on an outer surface of the housing 203.

The housing 203 is a tubular member molded of an insulative material, and has an open front end 205 in communication with the terminal receiving chambers 202. Terminals on a female connector (not shown) can be inserted through this open end 205. Mounting holes 206 for respectively passing wire harnesses (which are connected to terminals) therethrough are provided at the rear end of the housing 203, the mounting holes 206 provided in continuous relation to the terminal receiving chambers 202.

The lever lock portion 204 is provided on that portion of the housing 203 disposed adjacent to the rear end thereof having the mounting holes 206. The lever lock portion 204 serves to retain a retaining lever (see FIG. 14) pivotally mounted on the female connector (not shown).

The lever lock portion 204 comprises an elastically deformable, elastic lock plate 207 which extends upright from the outer surface of the housing 203, and has a lock release portion 208 extending from its free end. This lever lock portion 204 further comprises side walls 209 provided upright on opposite sides of the elastic lock plate 207, respectively. In this embodiment, the side walls 209 extend to a level higher than the position where the lock release portion 208 is provided. Of course, the side walls are capable of extending to a level lower than the position where the lock release portion is provided.

Namely, the lever lock portion 204 comprises the pair of upright side walls 209 and 209 spaced a predetermined distance from each other, and the elastic lock plate 207 which is provided between the side walls 209 in closely spaced relation thereto, and is elastically deformable in a direction perpendicular to the front and rear ends of the connector. In a normal condition of the side wall 209, its upper edge is disposed at a level higher than the position of the lock release portion 208 extending from the elastic lock plate 207.

The elastic lock plate 207 has a retaining hole 210 formed through a central portion thereof, which hole extends from the outer surface of the housing. This retaining hole 210 allows the elastic lock plate 207 to be easily elastically deformed so that the elastic lock plate 207 can be engaged with and disengaged from the retaining lever (not shown). The upper surface of the lock release portion 208 is formed into a stair-like step-configuration construction so that a pressing operation can be easily effected for releasing the locking.

A forward-fall prevention member 211 is mounted on and extends between upper edges of the side walls 209, and is disposed at a front position within the range of flexing of the lock release portion 208 displaceable in accordance with elastic deformation of the elastic lock plate 207, and the upper surface of the lock release portion 208 strikes against the forward-fall prevention member 211, thereby limiting a further movement of the lock release portion 208.

Rearward-fall prevention members 212 are formed on and project from the inner surfaces of the side walls 209, respectively, and extend along the axis of the housing 203. When the elastic lock plate 207 is elastically deformed, the lower surface of the lock release portion 208 strikes against the rear-fall prevention members 212. The rearward-fall prevention member 212 is in the form of a rib-like member which projects from the side wall 209, and extends horizontally.

A reinforcing structure of the lever lock of this embodiment is constituted mainly by the elastic lock plate 207, the lock release portion 208, the side walls 209, the retaining hole 210, the forward-fall prevention member 211 and the rearward-fall prevention member 212.

In the normal condition, all the constituent members and portions of the lever lock-reinforcing structure are disposed parallel to the upper surface of the housing 203, as shown in FIG. 11, and therefore this structure is suitable for being molded integrally with the housing 203, and hence can be formed without the use of a complicated slide mold.

Since the forward-fall prevention member 211 is mounted on and extends from the right and left side walls 209, it also serves to enhance the rigidity of the side walls 209.

Even if an external force as indicated by arrow $F_1$ (FIG. 12) acts on the lock release portion 208 of the lever lock portion 204 from the rear side to deform the elastic lock plate 207 forwardly, for example, during transport, the upper surface of the lock release portion 208 strikes against the forward-fall prevention member 211, thereby limiting the movement of this lock release portion 208. Then, even if a larger external force acts on the lock release portion 208, the lock release portion 208 is kept abutted against the forward-fall prevention member 211, and therefore a force larger than a predetermined value will not act on that portion interconnecting the elastic lock plate 207 and the lock release portion 208, and therefore breakage and deformation of these portions are prevented.

Even if an external force as indicated by arrow $F_2$ (FIG. 13) acts on the lock release portion 208 from the upper side, the lower surface of the lock release portion 208 strikes against the rearward-fall prevention members 212, and therefore the elastic lock plate 207 is prevented from being bent beyond a predetermined angle, and hence is prevented from breakage.

The forward-fall prevention member 211 and the rearward-fall prevention members 212 are provided respectively at front and rear positions within the range of displacement (flexing) of the elastic lock plate 207 and the lock release portion 208, and with this arrangement the effects of the lever lock-reinforcing structure can be obtained.

Figure 16:
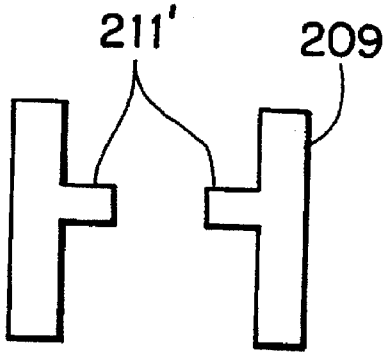
FIG. 16 is a front view showing another embodiment of forward-fall prevention member.

Of course, the present invention is not limited by this embodiment. As shown in FIG. 16, the forward-fall prevention member 211' may extend from an inner wall surface of the side wall and/or may include a pair of pieces, which are confronted from each other with a space.

In this embodiment, although the lever lock portion 204 is provided on the male connector 201, the present invention is not limited to such an arrangement. The female connector mated with the male connector 201 of this embodiment has a construction, and fixed shafts 213 formed on the male connector 201 are inserted and guided by the pivotal movement of the retaining lever pivotally mounted on the female connector, so that the male connector 201 can be inserted into and withdrawn from the female connector with a low insertion-withdrawal force.

As described above, in the lever lock-reinforcing structure of the present invention, the forward-fall prevention member is mounted on and extends from the side walls between which the elastic lock plate and the lock release portion are disposed, and the upper surface of the lock release portion strikes against this forward-fall prevention member, thereby limiting a forward fall of the elastic lock plate. Therefore, an external force will not act directly on the interconnecting portion of a bent configuration interconnecting the elastic lock plate and the lock release portion, thereby preventing this interconnecting portion from breakage.

In the lever lock-reinforcing structure of the invention, the forward-fall prevention member and the rearward-fall prevention members are provided parallel to the direction of mounting of the lock release portion, and therefore without the use of a slide mold, this structure can be produced by a mold easily removable in one direction, and this reduces the manufacturing cost.

What is claimed is:

1. A lever-type connector comprising:

a pivotal retaining lever provided on a first connector;

a second connector fitted relative to said first connector by pivotal movement of said retaining lever, the second connector having a lever lock portion for retaining said retaining lever and having a connection end for connection with said first connector, said lever lock portion including:

an elastic lock plate extending from an outer surface of a housing of said second connector;

a lock release portion extending from a free end of said elastic lock plate, said lock release portion being displaceable in accordance with elastic deformation of said elastic lock plate;

upstanding side walls provided respectively on opposite sides of said elastic lock plate; and a forward-fall prevention member mounted on and extending between said side walls, and disposed at a front position within the range of flexing of said lock release portion for limiting movement of the lock release portion in a direction towards said connection end, whereby when the elastic lock plate is elastically deformed, an upper surface of said lock release portion strikes against said forward-fall prevention member.

2. A lever-type connector as claimed in claim 1, further comprising:

rearward-fall prevention members formed on and projecting from an inner surface of said of said side walls for limiting movement of the lock release portion in a direction away from said connection end, the rearward-fall prevention member extending along an axis of said housing, whereby a lower surface of said lock release portion strikes against said rearward-fall prevention members upon elastic deformation of said elastic lock plate.

3. A lever-type connector as claimed in claim 1, wherein a retaining hole is formed in a central portion of said elastic lock plate.

4. A lever-type connector as claimed in claim 1, wherein an upper surface of said lock release portion is formed in a step configuration.

* * * * *